US010952515B2

(12) United States Patent
Morszeck

(10) Patent No.: US 10,952,515 B2
(45) Date of Patent: Mar. 23, 2021

(54) ITEM OF LUGGAGE

(71) Applicant: RIMOWA GmbH, Cologne (DE)

(72) Inventor: Dieter Morszeck, Cologne (DE)

(73) Assignee: RIMOWA GmbH, Cologne (DE)

( * ) Notice: Subject to any disclaimer, the term of this patent is extended or adjusted under 35 U.S.C. 154(b) by 220 days.

(21) Appl. No.: 15/777,268

(22) PCT Filed: Nov. 21, 2016

(86) PCT No.: PCT/EP2016/078234
§ 371 (c)(1),
(2) Date: May 18, 2018

(87) PCT Pub. No.: WO2017/085306
PCT Pub. Date: May 26, 2017

(65) Prior Publication Data

US 2018/0325230 A1 Nov. 15, 2018

(30) Foreign Application Priority Data

Nov. 20, 2015 (EP) ..... 15195671

(51) Int. Cl.

| | |
|---|---|
| ***A45C 13/00*** | (2006.01) |
| ***A45C 5/03*** | (2006.01) |
| ***A45C 13/04*** | (2006.01) |
| ***A45C 13/06*** | (2006.01) |

(52) U.S. Cl.
CPC ..... *A45C 13/005* (2013.01); *A45C 5/03* (2013.01); *A45C 13/04* (2013.01); *A45C 13/06* (2013.01)

(58) Field of Classification Search
CPC ..... A45C 13/005; A45C 5/03; A45C 13/04; A45C 13/06; A45C 5/02
See application file for complete search history.

(56) References Cited

U.S. PATENT DOCUMENTS

| | | | | | |
|---|---|---|---|---|---|
| 61,157 | A | * | 1/1867 | Cantel | A45C 5/02 |
| 158,237 | A | * | 12/1874 | Blake | E05D 11/0054 |
| 1,047,253 | A | * | 12/1912 | Leeds | E05D 11/0054 16/251 |

(Continued)

FOREIGN PATENT DOCUMENTS

| | | |
|---|---|---|
| CN | 203646690 U | 6/2014 |
| FR | 1193166 A | 10/1959 |

OTHER PUBLICATIONS

Office Action dated May 22, 2019, in corresponding Chinese Application No. 201680073760.2; 11 pages including English-language translation.

(Continued)

*Primary Examiner* — Tri M Mai
(74) *Attorney, Agent, or Firm* — Maier & Maier, PLLC

(57) ABSTRACT

An item of luggage having a first and a second luggage part. The first and the second luggage parts each have an outer side and an inner side, and having at least one hinge. The first and the second luggage parts are connected to one another via the at least one hinge and can be pivoted in relation to one another by the hinge. The hinge has a first and a second hinge part, and these are connected to one another in an articulated manner. The first hinge part is connected to the first luggage part and the second hinge part is connected to the second luggage part.

13 Claims, 5 Drawing Sheets

(56) References Cited

U.S. PATENT DOCUMENTS

| | | | | | |
|---|---|---|---|---|---|
| 1,048,934 | A | * | 12/1912 | Brandon | A45C 13/04 190/122 |
| 1,570,411 | A | | 1/1926 | Rhodes | |
| 2,052,826 | A | * | 9/1936 | Handschur | B65D 45/08 217/3 BC |
| 2,200,972 | A | * | 5/1940 | Stein | A45C 13/04 190/123 |
| 2,464,524 | A | | 3/1949 | Nathan | |
| 2,510,643 | A | | 6/1950 | Long | |
| 3,128,898 | A | * | 4/1964 | Burman, Jr. | A45C 13/005 220/4.22 |
| 3,967,708 | A | * | 7/1976 | Gregg | A45C 5/03 206/279 |
| 2011/0186396 | A1 | * | 8/2011 | Sheikh | A45C 5/03 190/111 |
| 2015/0257505 | A1 | | 9/2015 | Martinez | |

OTHER PUBLICATIONS

International Search Report with English translation and Written Opinion dated Jan. 17, 2017 of corresponding International Application No. PCT/EP2016/078234; 12 pgs.

European Office Action dated May 18, 2018 of corresponding European Application No. 15195671.1; 4 pgs.

* cited by examiner

ITEM OF LUGGAGE

FIELD

The invention relates to an item of luggage.

BACKGROUND

Items of luggage of the previously known type, particularly suitcases, comprise a first and a second luggage-piece portion, wherein the first and second luggage-piece portions each have an outer side and an inner side. Further, at least one hinge is provided via which the first and the second luggage-piece portion are connected to each other and are pivotable relative to each other. Said hinge often comprises a first and a second hinge portion which are articulated to each other, wherein the first hinge portion is connected to a first luggage-piece portion and the second hinge portion is connected to the second luggage-piece portion.

In items of luggage of the previously known type, there often occurs the problem that the items of luggage, when transported while stacked onto each other, may happen to be damaged by scratches.

SUMMARY

Thus, it is an object of the present invention to provide items of luggage which can be stacked onto each other without becoming scratched.

The present invention advantageously provides that the first hinge portion is connected to the first luggage-piece portion on the inner side of the first luggage-piece portion, and the second hinge portion is connected to the second luggage-piece portion on the inner side of the second luggage-piece portion.

The invention has the advantage that, in this manner, the hinge is arranged in a sunk position relative to the outer sides of the luggage-piece portions. Also when the items of luggage are being stacked upon each other, the hinge of one item of luggage will not cause scratches on the other item of luggage.

The present invention offers the additional advantage that such a sunk hinge is more appealing under the aesthetic aspect. A further advantage resides in that, even during transport, e.g. during luggage transport at an airport, the hinge is better protected and cannot be damaged easily.

The first hinge portion can comprise at least one first connection element, and the second hinge portion can comprise at least one second connection element, wherein said connection elements are adapted to be connected to each other to articulate the first hinge portion and the second hinge portion to each other. The first and the second hinge portion can be arranged on the first and the second luggage-piece portion in such a manner that, of the first and the second hinge portion, only respectively said at least one connection element of the first and the second hinge portion is visible from the outside.

This has the advantage that the hinge cannot be easily damaged.

At least a part of the first connection element and at least a part of the second connection element can be arranged in sunk positions relative to the outer side of the first and the second luggage-piece portion.

The first and the second connection element can respectively be designed as elongate hollow elements which engage into each other so as to articulate the first and the second hinge portion to each other.

Preferably, the hinge can be a one-axial hinge.

The elongate hollow elements of the first and the second hinge portion can form one axis of the hinge. Particularly the first and the second luggage-piece portion can be pivotable about this axis.

The elongate hollow elements of the first and the second hinge portion can have at least one pin element extending through them.

There can be provided a first frame element and a second frame element, wherein the first frame element can be arranged on the outer edge of the first luggage-piece portion and the second frame element can be arranged on the outer edge of the second luggage-piece portion, and wherein the contours of the first and the second frame element are adapted to each other in such a manner that, in the closed condition of the item of luggage, the first and the second frame element are in mutual engagement.

At least a part of the first hinge portion can be arranged between the first frame element and the first luggage-piece portion, and/or at least a part of the second hinge portion can be arranged between the second frame element and the second luggage-piece portion.

At least a respective part of the first and the second hinge portion can be plate-shaped.

In the closed condition of the item of luggage, the first and/or the second frame element can form an abutment.

It can be provided that the first and/or the second frame element form an abutment only in the area of the hinge.

It can be provided that, in the area of the hinge on the inner side of the first and the second luggage-piece portion, the first and the second frame element are bent in the direction of the interior of the item of luggage so that the first and the second hinge portion can be arranged between the respective frame element and the respective luggage-piece portion.

The first hinge portion can be bonded and/or screwed to the first luggage-piece portion and/or to the first frame element, and the second hinge portion can be bonded and/or screwed to the second luggage-piece portion and/or to the second frame element.

The first hinge portion can be clamped between the first luggage-piece portion and/or the first frame element, and the second first hinge portion can be clamped between the second luggage-piece portion and/or the second frame element.

An embodiment of the present invention is set forth in greater detail in the following description, including reference to the accompanying drawing.

DETAILED DESCRIPTION OF THE DRAWINGS

Figure 1:
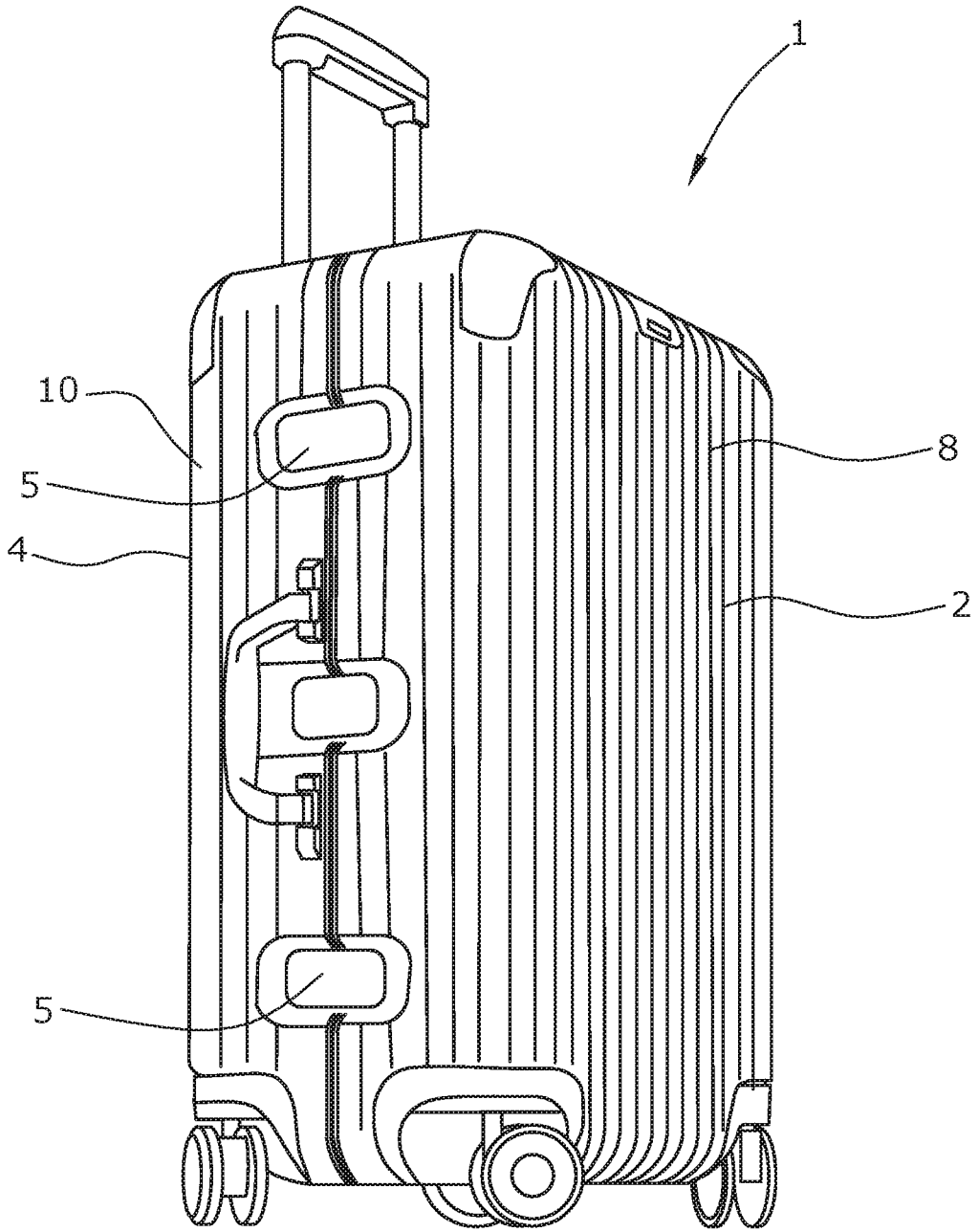
FIG. 1 is a view of the item of luggage according to the invention.

FIG. 1 shows an item of luggage 1 according to the invention. Particularly, the item of luggage 1 is a suitcase, preferably a suitcase adapted to roll on the ground by four rollers. The item of luggage 1 comprises a first and a second luggage-piece portion 2,4, wherein the first and the second luggage-piece portion 2,4 have a respective outer side 8,10 and a respective inner side 12,14.

The first and the second luggage-piece portion 2,4 are connected to each other by at least one hinge 16 and can be pivoted relative to each other by means of said hinge 16. In the closed state as shown in FIG. 1, the item of luggage 1 can be locked by means of locks 5.

Figure 2:
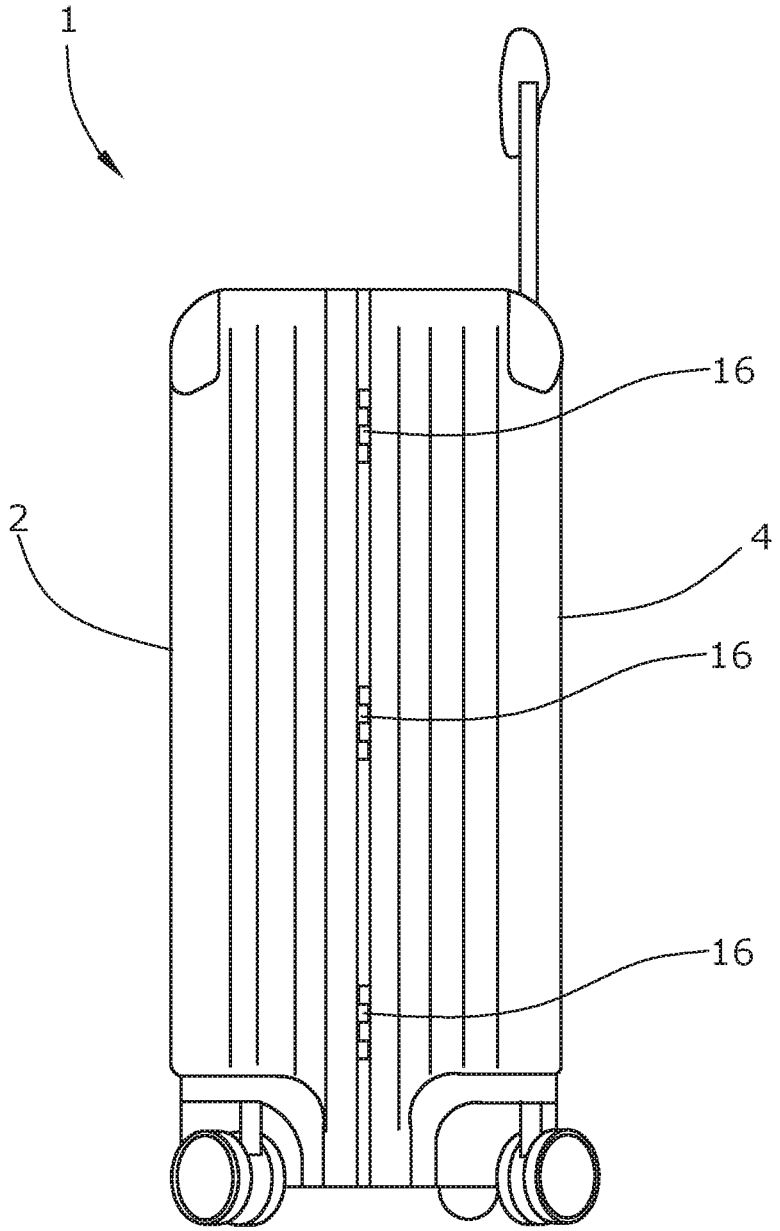
FIG. 2 is a view of the item of luggage according to FIG. 1 wherein the hinges are visible.

In FIG. 2, the item of luggage 1 is shown while allowing for a view onto the lateral surface of the item of luggage. On said lateral surface of the item of luggage, the first and the second luggage-piece portion 2,4 are connected to each other via at least one hinge 16. In the illustrated exemplary embodiment, the item of luggage 1 comprises three hinges. The hinge 16 comprises a first hinge portion 18 and a second hinge portion 20 which are articulated to each other, wherein said first hinge portion 18 is connected to the first luggage-piece portion 2 and said second hinge portion 20 is connected to the second luggage-piece portion 4.

The first hinge portion 18 is connected to the first luggage-piece portion 2 on the inner side 12 of the first luggage-piece portion 2, and the second hinge portion 20 is connected to the second luggage-piece portion 4 on the inner side 14 of the second luggage-piece portion 4. In this manner, the hinge 16 is visible from the outside only in the area where the first and the second hinge portion 18,20 are connected to each other.

Figure 3:
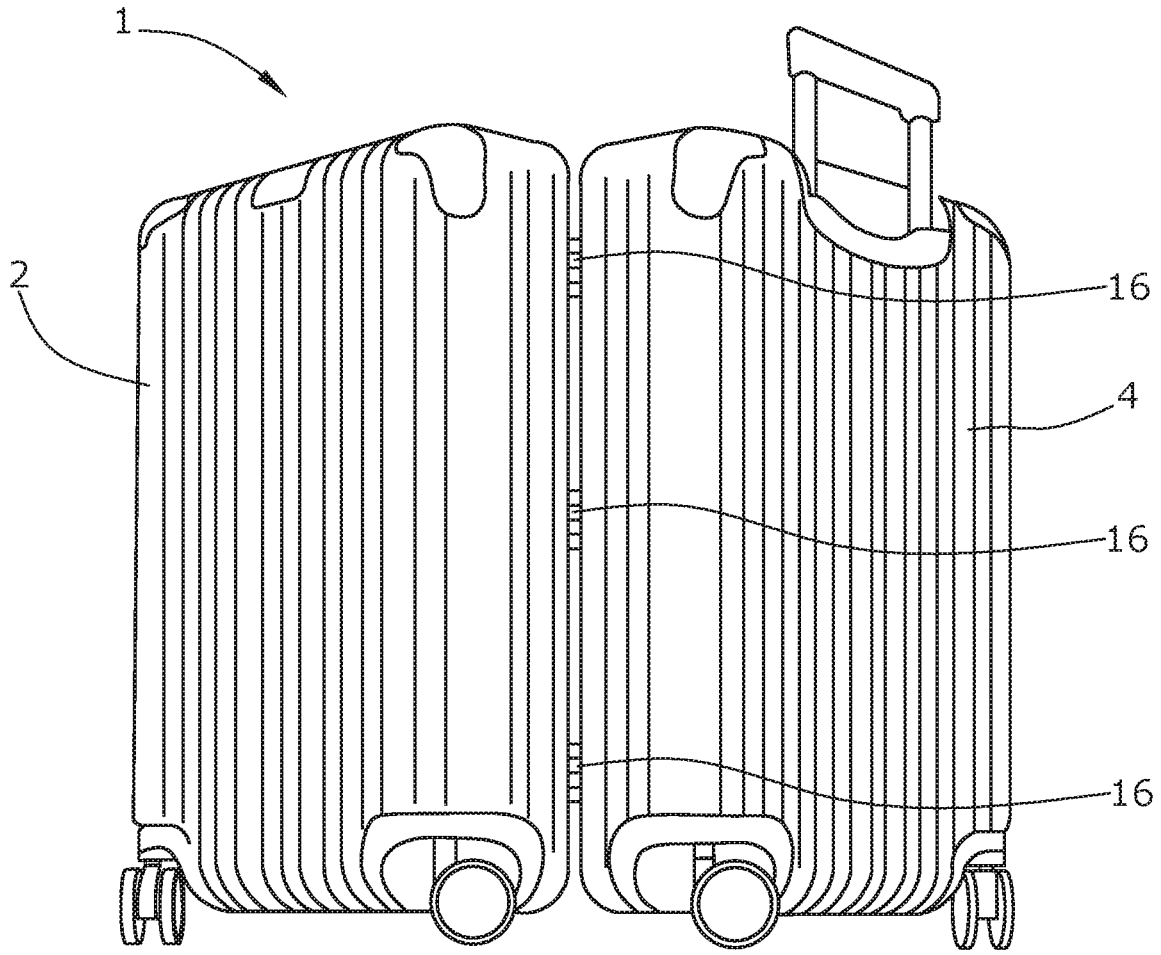
FIG. 3 is a view of the item of luggage according to FIGS. 1 and 2 in the opened state.

In FIG. 3, the item of luggage 1 is illustrated in the opened state. With the aid of the hinges 16, first luggage-piece portion 2 has been pivoted relative to the second luggage-piece portion 4. In FIG. 3, the item of luggage is shown with three hinges.

Figure 4:
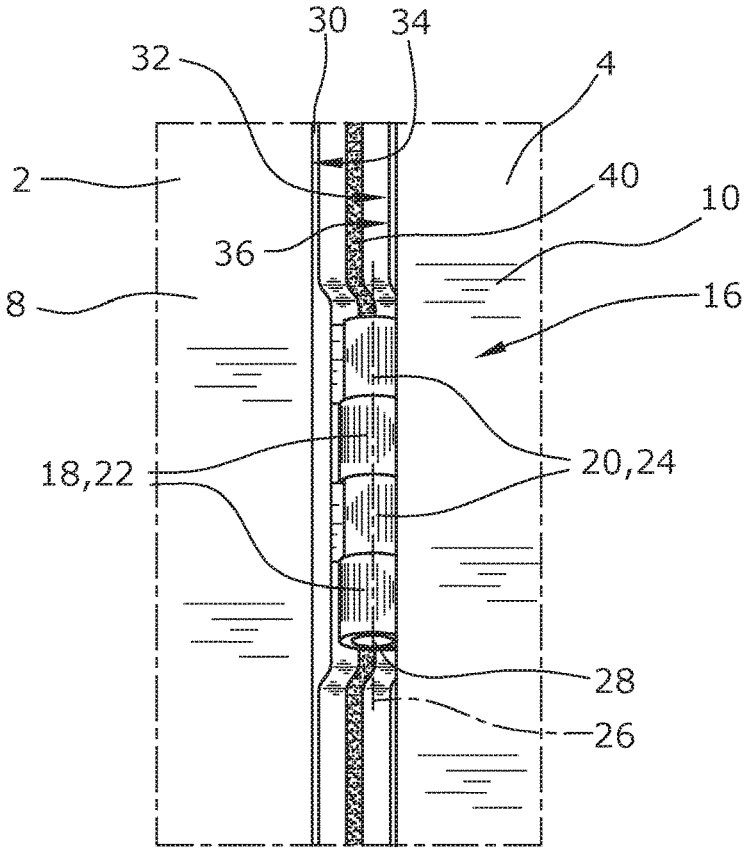
FIG. 4 is a partial view showing a hinge from the outside.

In FIG. 4, there is shown a partial view onto the outer sides 8,10 in the area of a hinge. The first hinge portion 18 comprises at least one first connection element 22, and the second hinge portion 20 comprises at least one second connection element 24, wherein said connection elements 22,24 can be connected to each other for connecting the first and the second hinge portion 18,20 to each other in an articulated manner. The first and the second hinge portion 18,20 are arranged on the first and second luggage-piece portions 2,4 in such a manner that, of the first and the second hinge portion 18,20, only respectively said at least one connection element 22,24 of the first and the second hinge portion 18,20 is visible from the outside. This is clearly visible in FIG. 4.

As illustrated by way of the exemplary embodiment shown in FIG. 4, the first and the second connection element 22,24 can respectively be designed as elongate hollow elements which engage into each other for articulating the first and the second hinge portion 18,20 to each other. In the exemplary embodiment depicted in FIG. 4, said elongate hollow elements of the first and the second hinge portion 18,20 form the axis 26 of the hinge. As illustrated, hinge 16 can be a one-axial hinge. As further illustrated, the elongate hollow elements of the first and the second hinge portion can have at least one pin element 28 extending through them.

The item of luggage 1 comprises a first frame element 30 and a second frame element 32, wherein the first frame element 30 is arranged on the outer edge 34 of the first luggage-piece portion 2 and the second frame element 32 is arranged on the outer edge 36 of the second luggage-piece portion 4. The contours of the first and the second frame element 30,32 are preferably adapted to each other in such a manner that, in the closed condition of the item of luggage, the outer edges of the first and the second frame element are in mutual engagement. Further, there is preferably arranged a rubber element 40 on the first frame element 30 and/or on the second frame element 32, wherein, in the closed state, said rubber element 40 is clamped between the first and the second frame element 30,32 so that the item of luggage can be closed in a water-tight manner.

Figure 5:
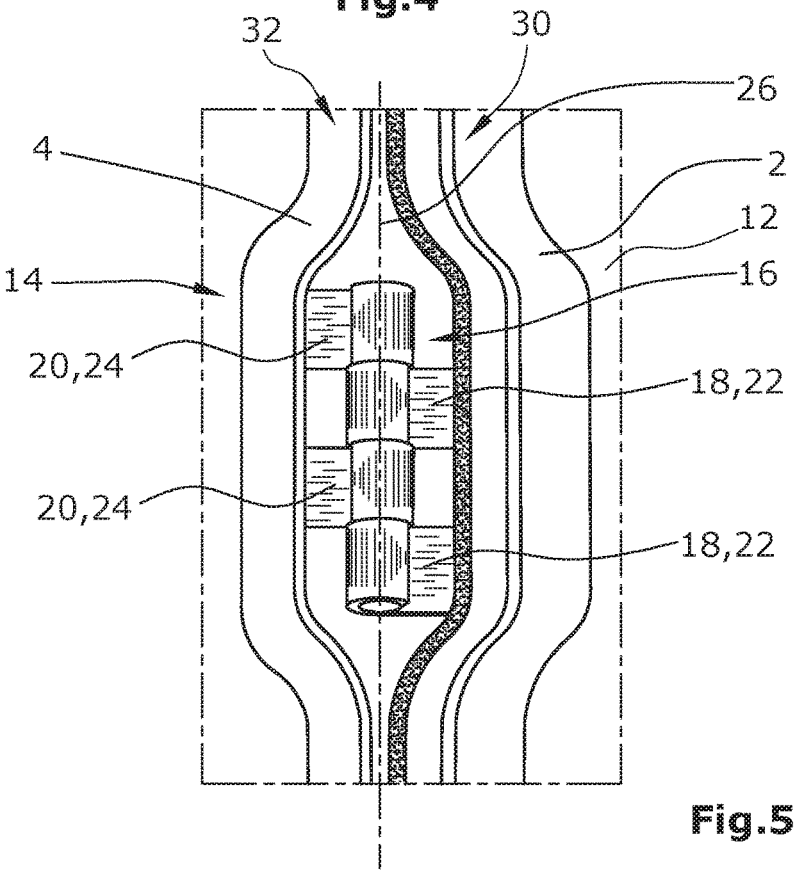
FIG. 5 is a partial view showing one hinge from the inside in the opened state of the item of luggage.
Figure 6:
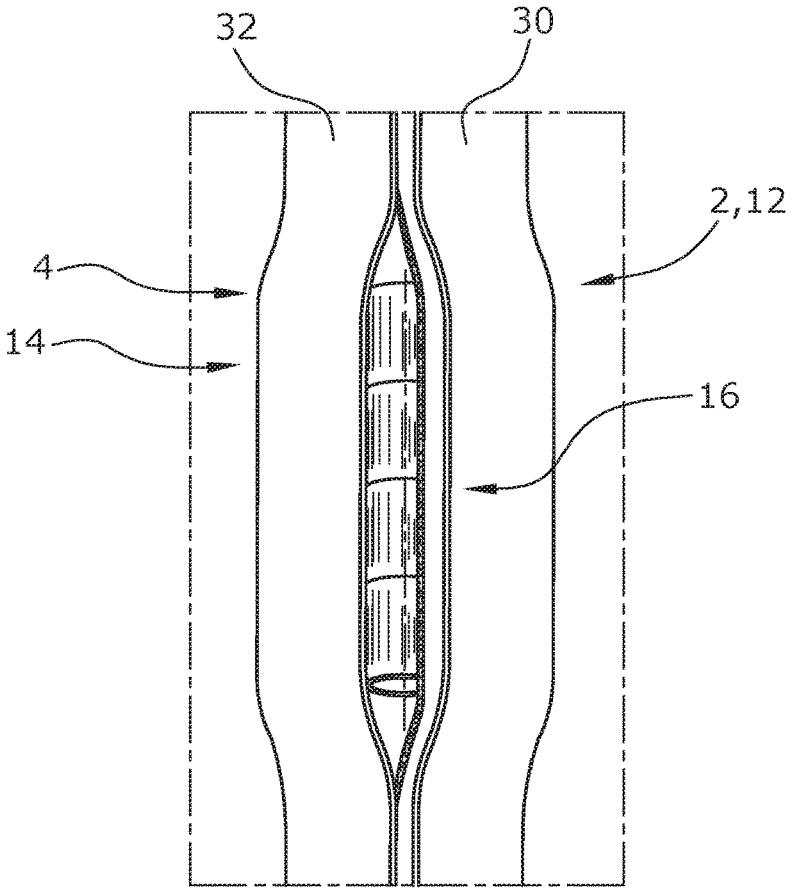
FIG. 6 is a further partial view showing an opened hinge as viewed from the inside.

FIGS. 5 and 6 are partial views onto the inner sides 12,14 of the item of luggage in the area of hinge 16, the luggage-piece portions 2,4 being shown in the opened state. In these views, also the first and the second frame element 30,32 are clearly visible. At least a part of the first hinge portion 18 is arranged between the first frame element 30 and the first luggage-piece portion 2, and/or at least a part of the second hinge portion 20 is arranged between the second frame element 32 and the second luggage-piece portion 4. In FIGS. 5 and 6, it is illustrated that, in the area of the hinge 16 on the inner side of the first and the second luggage-piece portion 2,4, the first and the second frame element 32,34 are bent in the direction of the interior of the item of luggage 1 so that the first and the second hinge portion 18,20 can be arranged between the respective frame element 30,32 and the respective luggage-piece portion 2,4.

In the illustrated exemplary embodiment, the first hinge portion 18 is screwed to the first frame element 30, and the second hinge portion 20 is screwed to the second frame element 32. The first hinge portion 18 can also be screwed or bonded to the first luggage-piece portion 2, and the second hinge portion 20 can also be screwed or bonded to the second luggage-piece portion 4.

Figure 7:
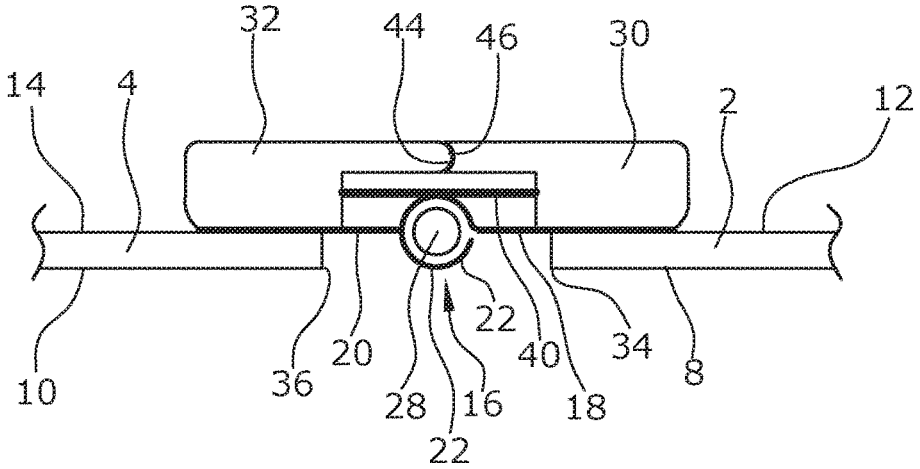
FIG. 7 is a schematic sectional view of a hinge according to the invention.

Shown in FIG. 7 is a sectional view of hinge 16, wherein the components, i.e. the first and the second frame element 30,32, the first and the second luggage-piece portion 2,4, the hinge 16 and the rubber seal 40 are illustrated only in a purely schematic manner and, with respect to their contours and sizes, do not exactly coincide with the exemplary embodiments of FIGS. 1 to 6. From FIG. 7, it can be gathered that at least a part of the first connection element 22 and at least a part of the second connection element 24 are arranged in sunk positions relative to the outer side 8,10 of the first and the second luggage-piece portion 2,4. Further, it can be seen in FIG. 7 that a pin element 28 extends in the first and the second connection element 22,24 that are formed as elongate hollow elements. At least a portion of the first and the second hinge portion 18,20 is of a plate-shaped design, wherein particularly that portion which is arranged between the respective luggage-piece portion 2,4 and the respective frame element 30,32, is plate-shaped. FIG. 7 further shows that, in the closed state of the item of luggage 1, the first and/or the second frame element 30,32 form an abutment. The outer edges 44,46 of the frame elements 30,32 at least partially engage into each other.

The invention claimed is:

1. An item of luggage, particularly a suitcase, comprising:

a first and a second luggage-piece portion, wherein the first and the second luggage-piece portion each have an outer side and an interior side, and at least one hinge, wherein the first and the second luggage-piece portion are connected to each other via said at least one hinge and are pivotable relative to each other by said hinge, wherein said hinge comprises a first and a second hinge portion which are articulated to each other, the first hinge portion being connected to a first luggage-piece portion and the second hinge portion being connected to the second luggage-piece portion, wherein the first hinge portion is connected to the first luggage-piece portion on the interior side of the first luggage-piece portion, and the second hinge portion is connected to the second luggage-piece portion on the interior side of the second luggage-piece portion, wherein a first frame element and a second frame element are provided, wherein the first frame element is substantially parallel to the first luggage-piece portion and is arranged on the outer edge of the first luggage-piece portion and the second frame element is substantially parallel to the second luggage-piece portion and is arranged on the outer edge of the second luggage-piece portion, wherein the contours of the first and the second frame element are adapted to each other in such a manner that, in the closed condition of the item of luggage, an outer edge of the first frame element is in mutual engagement with an outer edge of the second frame element, and wherein at least a part of the first hinge portion is arranged between the first frame element and the first luggage-piece portion, and/or at least a part of the second hinge portion is arranged between the second frame element and the second luggage-piece portion.

2. The item of luggage according to claim 1, wherein the first hinge portion comprises at least one first connection element, and the second hinge portion comprises at least one second connection element, wherein said connection elements are adapted to be connected to each other to articulate the first hinge portion and the second hinge portion to each other.

3. The item of luggage according to claim 2, wherein the first and the second hinge portion are arranged on the first and the second luggage-piece portion in such a manner that, of the first and the second hinge portion, only respectively said at least one connection element of the first and the second hinge portion is visible from the outside.

4. The item of luggage according to claim 2, wherein at least a part of the first connection element and at least a part of the second connection element are arranged in sunk positions relative to the outer side of the first and the second luggage-piece portion.

5. The item of luggage according to claim 2, wherein the first and the second connection element are respectively designed as elongate hollow elements which engage into each other so as to articulate the first and the second hinge portion to each other.

6. The item of luggage according to claim 5, wherein said elongate hollow elements of the first and the second hinge portion form an axis of the hinge.

7. The item of luggage according to claim 5, wherein the elongate hollow elements of the first and the second hinge portion have at least one pin element extending through them.

8. The item of luggage according to claim 1, wherein at least a respective part of the first and the second hinge portion is plate-shaped.

9. The item of luggage according to claim 1, wherein, in the closed condition of the item of luggage, the first and/or the second frame element form an abutment.

10. The item of luggage according to claim 9, wherein the first and/or the second frame element form an abutment only in the area of the hinge.

11. The item of luggage according to claim 1, wherein, in the area of the hinge on the interior side of the first and the second luggage-piece portion, the first and the second frame element are offset from a respective luggage-piece portion in the direction of the interior of the item of luggage so that the first and the second hinge portion are arranged between the respective frame element and the respective luggage-piece portion.

12. The item of luggage according to claim 1, wherein the first hinge portion is bonded and/or screwed to the first luggage-piece portion and/or to the first frame element, and the second hinge portion is bonded and/or screwed to the second luggage-piece portion and/or to the second frame element.

13. The item of luggage according to claim 1, wherein the first hinge portion is clamped between the first luggage-piece portion and/or the first frame element, and the second first hinge portion is clamped between the second luggage-piece portion and/or the second frame element.

* * * * *